US005463167A

United States Patent [19]

Ou

[11] Patent Number: 5,463,167

[45] Date of Patent: Oct. 31, 1995

[54] MERCURY REMOVAL BY DISPERSED-METAL ADSORBENTS

[75] Inventor: John D. Y. Ou, Houston, Tex.

[73] Assignee: Exxon Chemical Patents Inc., Linden, N.J.

[21] Appl. No.: 372,695

[22] Filed: Jan. 13, 1995

Related U.S. Application Data

[63] Continuation of Ser. No. 52,849, Apr. 23, 1992, abandoned, which is a continuation of Ser. No. 790,852, Nov. 12, 1991, abandoned, which is a continuation of Ser. No. 504,464, Apr. 4, 1990, abandoned.

[51] Int. Cl.[6] ..... C07C 7/12; C10G 17/00

[52] U.S. Cl. ..... 585/823; 585/820; 208/251 R; 208/253; 208/299; 208/310 R

[58] Field of Search ..... 585/823, 820; 208/251 R, 253, 299, 310 R, 310 Z

[56] References Cited

U.S. PATENT DOCUMENTS

| | | | |
|---|---|---|---|
| 3,704,875 | 12/1972 | Waltrich | 75/81 |
| 3,755,989 | 9/1973 | Fornoff et al. | 604/348 |
| 3,883,426 | 5/1975 | Lewandowski et al. | 210/707 |
| 3,954,603 | 5/1976 | Curtin | 208/253 |
| 4,006,077 | 2/1977 | Wegner et al. | 208/251 H |
| 4,417,626 | 4/1979 | Findlay et al. | 169/37 |
| 4,486,298 | 12/1984 | Bowes et al. | 208/253 |
| 4,645,587 | 2/1987 | Kokayeff | 208/91 |
| 4,709,118 | 11/1987 | Yan | 585/820 |
| 4,909,926 | 3/1990 | Yan | 208/253 |
| 4,911,825 | 3/1990 | Roussel et al. | 208/251 R |
| 4,986,898 | 1/1991 | Torihata et al. | 208/251 R |
| 5,037,552 | 8/1991 | Furuta et al. | 210/634 |
| 5,062,948 | 11/1991 | Kawazoe et al. | 208/251 R |

FOREIGN PATENT DOCUMENTS

| | | |
|---|---|---|
| 0342898 | 11/1989 | European Pat. Off. . |
| 0352420 | 1/1990 | European Pat. Off. . |
| 0385742 | 9/1990 | European Pat. Off. . |
| 0412862 | 2/1991 | European Pat. Off. . |
| 2144567 | 3/1972 | Germany . |
| 1307543 | 2/1973 | United Kingdom . |

OTHER PUBLICATIONS

*Encyclopedia of Chemical Technology,* 3d Edition, vol. 15, pp. 168–169 (1981).

*Primary Examiner*—Anthony McFarlane
*Assistant Examiner*—Nhat D. Phan
*Attorney, Agent, or Firm*—Linda K. Russell

[57] ABSTRACT

A method of removing contaminants from a hydrocarbon stream which involves contacting the hydrocarbon stream containing a heavy-metal contaminant with a porous material under conditions suitable for adsorption of the contaminant by the porous material. A process for preparing an adsorbent which involves forming a mixture of metal oxide powder and support powder, shaping the mixture into an aggregate, and reducing the aggregate to transform the metal oxide to the metallic state.

2 Claims, No Drawings

MERCURY REMOVAL BY DISPERSED-METAL ADSORBENTS

This is a continuation of application Ser. No. 08/052,849, filed Apr. 23, 1992, which is a continuation of application Ser. No. 07/790,852, filed Nov. 12, 1991, which is a continuation of application Ser. No. 07/504,464, filed Apr. 4, 1990, all of which are abandoned.

BACKGROUND OF THE INVENTION

1. Field of the Invention

The present invention relates to adsorbents made from active metals dispersed on inert porous supports, such as alumina, silica aluminosilicates, zeolites, clay and the like effective for removing low level elemental mercury from hydrocarbons.

2. Discussion of Background and Material Information

The present invention is based on the discovery that elemental mercury in naphtha can pass through a steam cracker somewhat unscathed and can attack the aluminum bundles of a down-stream cold box resulting in the failure thereof. In addition to the economics associated with the failure of the cold box, a collapse of the cold box would also pose environmental problems.

Various attempts have been made in the prior art to remove mercury contaminants from hydrocarbon streams. For example, it is known that elemental mercury can be removed from a hydrocarbon stream using a packed bed of metal particles, such as copper, silver, aluminum and zinc. In so doing, the mercury forms an amalgam with the active metals and remains on the particle surface.

The previous attempts to remove mercury, however, have not been found to be successful in preventing elemental mercury in naphtha from passing through the steam cracker. First, the particles of metal are not porous so that only the outer surface is available for a mercury reaction and adsorption. Consequently, the column size and amount of metal required to treat high volumes of naphtha are somewhat impractical. Second, the outer surface of the active metals, such as aluminum, copper, and zinc is typically covered with a layer of metal oxides. Thus, an acid-wash pre-treatment is normally needed to remove the oxide layer and activate the metal particles before use for this purpose. The latter treatment, however, imposes extra difficulties on safety, operations, and waste disposal. For the sulfide approach, its operations include precipitation, filtering and handling of a wet filter cake which are inefficient.

U.S. Pat. No. 4,417,626, DOMTAR Inc., discloses the use of sodium sulfide to remove mercury from wastewater.

J.P. 62-68,584, KOKAI Tokyo Koho, uses arsenic sulfite to remove mercury from wastewater.

U.S. Pat. No. 3,704,875, PENNWALT Corp., discusses the use of active metal particles, including zinc and aluminum, to remove mercury from aqueous streams such as wastewater and other industrial wash effluents.

U.S. Pat. No. 3,883,426, ETUDES ET PROCEDES d'ASSAINISSEMENT PURATOR, also discusses the use of active metal particles including zinc and aluminum to remove mercury from aqueous streams, such as wastewater and other industrial wash effluents.

Sulfides, such as sodium sulfide, have also been proposed to precipitate the mercury from the hydrocarbon liquid.

Related to the foregoing, other techniques have been proposed for the removal of mercury from liquids and gases.

An example of technology of mercury removal from liquids and gases is outlined in the *Encyclopedia of Chemical Technology,* 3d Edition, Vol. 15, pp. 168–169 (1981).

It has also been proposed to adsorb mercury on high surface area substrates, such as activated carbon.

French Patent No. 2,310,795, INSTITUTE FRANCAIS DU PETROLE, discloses the removal of mercury from gases and liquids using an adsorbent mass of metal on a ceramic support. The method disclosed involves contacting the gas or liquid with an adsorbent mass containing a) $SiO_2$, $Al_2O_3$ silica-alumina, a silicate, and aluminate or an aluminosilicates support, and b) one or more metals which form alloys with mercury. The adsorbent mass is disclosed as having a specific surface area of greater than 40 $m^2/g$, i.e. 40–250 $m^2/g$, and the metal in the mass is present as crystallites having an average diameter of less than about 400 Angstroms, and preferably less than 100 Angstroms. The support is disclosed as preferably being $Al_2O_3$ and the preferred metal is Ag or a mixture Ag with Au, Ni or Cu. The adsorption mass may also contain $ThO_2$ or MgO. It is disclosed that the activation of the adsorption mass and/or its regeneration are effected by heating in the presence of a like hydrocarbon and optionally steam. The support is disclosed as preferably being in the form of 1–10 mm diameter balls, such as extrudates or pellets. Optionally, the support may be mixed with the active phase and then formed into pellets. The adsorbent metal is used in amounts of 200 ppm—20%, and more preferably 0.05–1% for Au and 0.1–5% for Ag or Cu. It is disclosed, however, that other metals may be present in amounts within the range of 0–20% and preferably 0.01–10%. It is also disclosed that regeneration is effected by heating at 200°–500° C., and preferably 320°–420° C. in a current of inert or reducing gas.

NL 7613–998, Institute Francais Du Petrole, discloses the use of dispersed sulfided metal on an inorganic carrier to remove mercury from gases or liquids by contacting the fluid with a fixed bed of an adsorbent comprising Cu sulfide on $SiO_2$, $Al_2O_3$, $SiO_2$—$Al_2O_3$, silicate, aluminate or alumina silicate support in the treatment of natural gas, liquified natural gas, and electrolytically produced $H_2$.

SU 633,565, KAZEA UNIVERSITY, is directed to the removal of mercury from industrial air by using a silica gel adsorbent containing silver oxide. The adsorbent is disclosed as being prepared by impregnating silica gel with silver nitrate and calcining.

JP 52-105,578, MITSUI MINING & SME, is directed to the removal trace mercury from exhaust gases by adsorption in columns packed with noble metal-supporting, nonmetallic fibers, e.g. of quartz.

DE 3,026,430, NIPPON KOKAN K.K., discloses the removal of resolved heavy metals from liquids by adsorption of metals on steelwork slag, which is disclosed as being particularly suitable for removing mercury and the like, from waste water.

JP 53-73,859 discloses the use of ferrous salts on activated carbon for the removal of mercury ions from effluent.

JP 49-74,195, SUMITOMO CHEMICAL CO., LTD., discloses the use of an activated carbon impregnated with copper for mercury removal from gas.

The following patents relate to mercury removal over activated carbons.

U.S. Pat. No. 3,755,989, UNION CARBIDE CORPORATION, is directed to mercury removal from a gas stream by feeding the stream to a carbon adsorbent bed.

French Patent No. 2 206 843, SHOWA DENKO K.K., is directed to removal of mercury from gases by adsorption on active carbon treated with sulfuric acid.

JP 5 2053-793, SUMITOMO METAL MINI K.K., is directed to the removal of trace mercury from sulfuric acid by conversion to bromide or iodide followed by adsorption on activated carbon.

DL 107-890, BEILING H., is directed to removing mercury from effluent waters by adsorption on active carbon and ion exchange resin and elusion.

SU 640-750, FEDOROVSKAYA L. F., is directed to removal of mercury from industrial waste gas by adsorption on activated carbon in the presence of chlorine for high adsorption capacity.

DE 160-802-A, CHEM WERK BUNA VEB, is directed to mercury removal from gas by adsorption on sulfur-containing active carbon.

SU 1161-157-A, SECONDARY RESOURCES, is directed to the removal of mercury vapor from gases by adsorption on activated charcoal treated with vinyl chloride oligomers.

However, removal of mercury contaminants from the hydrocarbon stream is a problem which has been solved by the present invention, as described in more detail hereinafter, in a manner which is believed to be novel and unobvious relative to what has been taught by the prior art.

SUMMARY OF THE INVENTION

In contrast to the prior art, the present invention is directed to the removal of mercury using an adsorbent manufactured by a technique which involves extruding or pelletizing mixtures of metal oxide powder and support powder which is then reduced to transform the oxide to the metallic state. Also, in contrast to what is taught or suggested by the prior art, the active metals used in the adsorbent manufactured in accordance with the present invention include platinum, palladium, gallium, and indium. Furthermore, the present invention is directed to the removal of mercury and other heavy metal contaminants from a liquid hydrocarbon feedstream, such as naphtha feedstock.

The present invention, therefore, is directed to an effective way of removing low level elemental and/or ionic mercury from a hydrocarbon stream, such as a liquid or gas hydrocarbon stream, and preferably a liquid naphtha feedstock.

The method of removing mercury from a liquid hydrocarbon feedstream preferably involves packing a column with porous dispersed-metal adsorbent and passing mercury-contaminated hydrocarbon through the column at a temperature ranging from about ambient to about 100° C. and a pressure from ambient to about 300 psig.

Adsorbents suitable for purposes of the present invention may be prepared by the following procedures. A powder of nickel oxide or copper oxide may be mixed with a porous inert material, such as gamma-alumina powder, and co-extruded into extrudates. The extrudates are then dried and reduced under a hydrogen atmosphere to change the metal oxides to the active metallic state.

Alternatively, preparation of an adsorbent suitable with for purposes of the present invention involves impregnating a porous inert support, such as gamma-alumina spheres, with salts including $H_2PtCl_6$, $PdCl_2$, $Cu(NO_3)_2$, $AgNO_3$, and $Ni(NO_3)_2$. The impregnated adsorbents are then oxidized in dry air or oxygen and reduced in hydrogen. The active metals on the adsorbent so prepared have been observed to be in the form of dispersed metal clusters. The amount of atoms on these adsorbents available for mercury action, therefore, is much larger than simple metal particles.

Inasmuch as the dispersed-metal adsorbents maximize the use of active metals, the column size and the cost of metal are significantly reduced. In addition, the hydrogen reduction of the adsorbents can be conducted in situ at fairly mild conditions prior to use. Furthermore, the disadvantages of prior art requirements for an acid-wash pretreatment for conventional metal particles are avoided.

DETAILED DESCRIPTION OF THE INVENTION

In general, the present invention is directed to a method of removing contaminants from a hydrocarbon stream which involves contacting a hydrocarbon stream containing at least one contaminant including a heavy metal with a porous material capable of adsorbing the contaminant under conditions suitable for adsorption.

The present invention is also directed to a process for preparing an adsorbent, suitable for this purpose, which involves forming a mixture of metal oxide powder and support powder, shaping the mixture into an aggregate of the metal oxide and the support powders, and reducing the aggregate to transform the metal oxide to the metallic state.

In addition, the present invention is directed to a liquid hydrocarbon which contains less than about 5 ppb of such heavy metal.

The present invention is also directed to an adsorbent aggregate of active metal powder and support powder produced in accordance with the present invention.

In addition, the present invention is directed to a steam cracking process which involves contacting a liquid hydrocarbon stream containing an amount greater than about 5 ppb mercury with a porous adsorbent capable of adsorbing the mercury under conditions suitable for such adsorption so as to reduce the amount of mercury in the hydrocarbon stream to less than about 5 ppb, prior to subjecting the resultant hydrocarbon stream to steam cracking conditions.

In accordance with the present invention, the metal oxide of the adsorbent may be an oxide of a metal selected from the group consisting of Group I B metals, Group III A metals, and Group VIII B metals. For purposes of the present invention, the Group I B metals are preferably selected from the group consisting of Cu, Ag, and Au; the Group IIIA metals are preferably selected from the group consisting Ga, In, and Tl, the Group III B metals are preferably selected from the group consisting of Ni, Pd, and Pt.

For purposes of the present invention, the support powder may be a member selected from the group consisting of crystalline alumino silicates, such as zeolites, amorphous aluminosilicates, such as chemical mixtures of alumina and silica, clays, silica, and alumina, but preferably the support powder is selected from the group consisting of clays and alumina. In the embodiment where the support powder is selected from the group consisting of clays and alumina, the metal oxide powder is preferably selected from the group of powders consisting of nickel oxide, copper oxide, cobalt oxide, zinc oxides and mixtures of two or more thereof. In a preferred embodiment, wherein the support powder is clay, the metal oxide is nickel oxide. In another preferred embodiment, wherein the support powder is selected from the group consisting of alumina, zinc oxide and mixtures of alumina and zinc oxide, the metal oxide is preferably a powder selected from the group consisting of nickel oxide, copper oxide, and mixtures thereof. In another preferred embodiment, the aggregate includes copper oxide, zinc oxide, and alumina preferably wherein the copper is present in an amount up to about 25 wt % and is blended with the support powder of zinc oxide and alumina, and most preferably wherein the amount of metallic copper is greater than about 20 wt %.

In accordance with the present invention, the porous adsorbent preferably has a surface area within the range of about 50 $M^2$/grams and 750 $M^2$/grams, and most preferably within the range of about 100 $M^2$/grams and about 500 $M^2$/grams. Related to this, the porous adsorbent may be in the form of crushed particles or beaded particles which are spherical.

In the process for producing adsorbents in accordance with the present invention, the mixture of metal oxide powder and support powder is preferably shaped by extrusion or pelletizing, but preferably extrusion to form an extrudate.

The method for removing heavy metal contaminants in accordance with the present invention is most preferred for removing mercury from liquid hydrocarbon streams, such as naphtha, which contain up to about 40 ppb, e.g., an Algerian condensate, so as to result with a product stream containing an amount of mercury up to about 5 ppb, e.g., between about 2.0 ppb to about 4.5 ppb, or between about 2.3 ppb and about 4.2 ppb, but preferably less than about 1 ppb mercury.

Adsorbent Preparation

The adsorbents useful for purposes of the present invention are prepared as follows. The active metal powder, such as cupric oxide or nickel oxide, and the support powder, such as Catapal alumina, Bentonite clay, Kaolin clay, and similar materials are mixed to form a resultant composition wherein the active metal powder and support powder are present within the ranges of about 90% metal oxide and 10% support powder, to about 10% metal oxide and 90% support powder, more preferably wherein the range is 80% metal oxide/20% support powder to about 20% metal oxide/80% support powder, and most preferably within the range of about 70% metal oxide/30% support powder to about 30% metal oxide/70% support powder. The resultant composition is then agglomerated into particles for example using conventional agglomeration techniques, such as extrusion, pelletizing, tabeling, and the like, with extrusion being most preferred. The resultant agglomerate, such as extrudates, are then subjected to drying conditions, preferably in air having a temperature within the range of 200° F. to 400° F. or to a nitrogen purge to reduce the moisture level to below about 5% by weight. The dried agglomerate is then subjected to conditions which will effect a reduction of the metal oxide to the metallic state. The preferred reducing agent used for this purpose is hydrogen or a hydrogen-containing gas, such as nitrogen. In this regard, the reducing agent may be substantially 100% hydrogen, or an inert gas, such as nitrogen, containing 1–2% hydrogen. The reduction of the metal oxide to the metallic state may be carried out at temperatures within the range of about 300° F.–900° F. and at pressures within the range of about 100 psig–500 psig. For example, in the manufacture of adsorbents containing cupric oxide, the reduction is preferably carried out in a gaseous atmosphere of nitrogen containing about 1–2% hydrogen at temperatures within the range of 300° F.–500° F. and at 100–500 psig. In another example, for the manufacture of adsorbents suitable for purposes of the present invention containing nickel oxide, reduction is preferably performed with 100% hydrogen at a temperature within the range of 300° F.–900° F. and at a pressure within the range of 100–500 psig.

Adsorption Procedure

In accordance with the present invention, heavy metal contaminants may be removed from a hydrocarbon stream by contacting the hydrocarbon stream with the adsorbent, as described above, under conditions suitable for adsorption of the contaminant by the adsorbent. Preferably the hydrocarbon stream is a liquid hydrocarbon stream, such as a naphtha stream containing an amount up to about 40 ppb mercury as the contaminant. More preferably, however, the naphtha stream is an Algerian condensate composed of on a total weight basis: $C_3$, paraffins 0.1%; $C_4$ paraffins 5.0%; $C_5$ paraffins and $C_5$ naphthene, 13.6%; $C_6$ paraffins and $C_6$ naphthene, 13.8%; Benzene, 2.0%; $C_7$ paraffins and $C_7$ naphthene, 14.0; Toluene, 1.0%; $C_8$ paraffins and $C_8$ naphthene, 11.0%; Ethylbenzene, 0.2%; Ortho-xylene, 0.5%; Para-/Meta-xylene, 2.2%; $C_9$ paraffins and naphthene, 9.0%; $C_9$ aromatics, 3.8%; $C_{10}$ paraffins and naphthene, 6.4%; $C_{10}$ aromatics, 0.4%; $C_{11}$ paraffins and naphthene, 5.1%; $C_{11}$ aromatics, 0.2%; $C_{12}$ compounds, 4.6%; $C_{13}$ compounds, 3.0%; $C_{14}$ compounds, 1.8%; $C_{15}$ compounds, 1.6%; $C_{18}$ compounds, 0.2%; $C_{19}$ compounds, 0.2%; $C_{20}$ compounds, 0.1%; $C_{21}$ compounds, 0.1% $C_{22}$ compounds, 0.1%; $C_{23}$ compounds, 0.1%; Sulfur, 20 ppm; nitrogen, 30 ppm; and some oxygenated compounds (exact concentration unknown).

The conditions suitable for adsorption in accordance with the present invention include a temperature ranging from about ambient to about 100° C., and pressures ranging from ambient to about 300 psig.

Preferably, mercury removal is performed in a fixed-bed operation wherein the adsorbent selected for the particular adsorption procedure is loaded into a column or other suitable container or vessel. Air or any other oxygen-containing compounds, are then exhausted from the column inasmuch as even a trace level of oxygen would adversely affect the effectiveness of the adsorption process. Following the exhaustion or evacuation of air or other oxygen-containing compounds from the column and connecting lines, the hydrocarbon from which the mercury is to be adsorbed is pumped through the column, preferably in an up-flow direction at a flow rate, preferably within the range of 1–10 LHSV (liquid hourly space velocity), and more preferably at a flow rate of 1– 3 LHSV. For purposes of the fixed-bed operation for adsorption of mercury from liquid hydrocarbon streams in accordance with the present invention, adsorption conditions also include a column temperature which should be maintained at between about ambient –300° F. and preferably within the range of about 100°–200° F. The column pressure should be maintained within the range of 50– 500 psig, and preferably within the range of 100 to 300 psig.

In general, however, the adsorption process in accordance with the present invention involves passing the naphtha stream through a column packed with the adsorbent to remove at least about 80% by total weight of the mercury. The resultant stream from which the mercury has been removed, contains an amount of mercury between about 1 ppb and about 5 ppb, preferably between about 2.0 to about 4.5 ppb, and more preferably between about 2.3 ppb and about 4.2 ppb. Most preferably, however, the resultant stream from which mercury has been removed in accordance with the present invention contains less than about 1 ppb.

More specifically, the present invention, which is directed to a method of removing contaminants from a hydrocarbon stream, involves contacting a liquid hydrocarbon stream containing at least one contaminant comprising a heavy metal with a porous material capable of adsorbing the contaminant under conditions suitable for adsorption of said contaminant by the porous material.

The material capable of adsorbing the heavy metal in accordance with the present invention includes a porous adsorbent composed of a support selected from the group consisting of crystalline aluminosilicates; amorphous aluminosilicate; alumina; silica; clay and metal oxides; wherein the crystalline aluminosilicates are zeolites; wherein the amorphous aluminosilicates are chemically mixed alumina and silica; wherein the alumina is selected from the group consisting of gamma-alumina and catapal alumina; wherein the clays are selected from the group consisting of attapulgite, kaolin, Bentonite clay, and Fuller's earth; and wherein the metal oxides are selected from the group consisting of nickel oxide, copper oxide, and mixtures of two or more of nickel oxide, copper oxide, cobalt oxide; or wherein the metal oxides are supported on a member selected from the group consisting of alumina and clay. Preferably, the metal oxides are supported on alumina, wherein said alumina is gamma-alumina powder, or wherein the metal oxides are selected from the group consisting of nickel oxide and copper oxide.

For purposes of the present invention, the porous material capable of adsorbing the heavy metal comprises active metals dispersed on the adsorbent, preferably wherein the active metals are selected from the group consisting of Group I B metals, Group IIIA metals, and Group VIII B metals, and more preferably wherein the metals are Group IB metals, which are selected from the group consisting of Cu, Ag and Au, or wherein the metals are Group IIIA metals, selected from the group consisting of Ga, In, and Tl, or wherein the metals are Group VIIIB metals selected from the group consisting of Ni, Pd and Pt.

Preferably the porous adsorbent has a surface area within the range of about 50 $M^2$/grams to about 750 $M^2$/grams, and more preferably is between about 75 $M^2$/grams and 600 $M^2$/grams, and most preferably within the range of about 100 $M^2$/grams to about 500 $M^2$/grams. The porous adsorbent is substantially in the form of crushed particles, such as beaded particles, preferably wherein the beaded particles are spheres.

For purposes of the present invention, the hydrocarbon stream preferably is in the liquid state, such as a naphtha stream, wherein the naphtha stream contains an amount up to about 2 ppm mercury as the at least one contaminant, and the mercury is selected from the group of elemental mercury and ionic mercury. Most preferably, the naphtha stream is Algerian condensate, as defined hereinabove.

In accordance with the present invention, the process conditions include a temperature ranging from ambient to about 100° C. and pressures from ambient to about 300 psig; and the process involves passing the naphtha stream through a column packed with the adsorbent to remove at least about 90% by total weight of the mercury. Preferably the adsorbent comprises reduced nickel supported on clay, and a substantial amount of the mercury is removed by such adsorbent so as to result in a product stream containing an amount of mercury up to about 5 ppb, and typically within the range of about 2.0 to about 4.5 ppb, i.e., an amount of mercury between about 2.3 ppb and about 4.2 ppb; however, most preferably, substantially all of the mercury is removed by the adsorbent so as to result in a product stream containing less than 1 ppb mercury.

For purposes of the present invention, the adsorbent comprises reduced copper supported on zinc oxide and alumina, or impregnated adsorbents including platinum, or impregnated adsorbents including palladium, or impregnated adsorbents including gallium, or impregnated adsorbents including indium.

The present invention is also directed to a process for preparing an adsorbent which involves forming a mixture of metal oxide powder and support powder, shaping the mixture into an aggregate comprising the metal oxide and the support powder, and reducing the aggregate to transform the metal oxide to the metallic state, wherein the metal oxide comprises a metal selected from the group consisting of Group IB metals, Group IIIA metals and Group VIIIB metals, and also wherein the metals are Group IB metals, wherein the Group IB metals are selected from the group consisting of Cu, or wherein the metals are Group IIIA metals, wherein the Group IIIA metals are selected from the group consisting of Ga, In and Tl, or wherein the metals are Group VIIIB metals, wherein the Group VIIIB metals are selected from the group consisting of Ni, Pd and Pt.

In accordance with the present invention, the support powder is preferably a member selected from the group consisting of zeolites, amorphous aluminosilicates, silica, clays and alumina, wherein the support powder is selected from the group consisting of clays and alumina. When the metal oxide powder is selected from the group of powders consisting of nickel oxide, copper oxide, zinc oxide and mixtures of two or more powders selected from the group consisting of nickel oxide, copper oxide and zinc oxide, in the support power is preferably clay. When the metal oxide is copper oxide, the support powder is preferably selected from the group powders consisting of alumina oxide, zinc oxide and mixtures of alumina and zinc oxide.

In the process in accordance with the present invention, the shaping step involves a technique selected from the group consisting of extruding and pelletizing the mixtures of metal oxide and the support powder, wherein the shaping involves extruding the mixtures of metal oxide and the support powder to form an extrudate, and further involves reducing the extrudates under a hydrogen atmosphere, in addition to drying the extrudates.

The present invention is also directed to a steam cracking process which involves contacting a liquid hydrocarbon stream containing an amount greater than about 5 ppb mercury with a porous adsorbent capable of adsorbing the mercury under conditions suitable for adsorption of the mercury to reduce the amount of mercury to less than about 5 ppb; and subjecting the resultant hydrocarbon stream containing less than about 5 ppb mercury to steam cracking conditions.

The following non-limiting examples are given by way of illustration of the present invention.

EXAMPLE I

The following static adsorption tests were performed to evidence the advantages of the present invention.

For purposes of these examples, the adsorbents were 1) reduced copper on zinc oxide and alumina, and 2) reduced nickel on clay. The feed solution was Algerian condensate. The test conditions and results are listed below.

| Adsorbent | T | P | Hg in Feed | Hg in Product |
|---|---|---|---|---|
| Cu/ZnO+ $Al_2O_3$ | Ambient | Ambient | 32 ppb | <1 ppb |
| Cu/ZnO+ $Al_2O_3$ | 65° C. | 30 psig | 32 ppb | <1 ppb |
| Cu/ZnO+ $Al_2O_3$ | 100° C. | 50 psig | 32 ppb | <1 ppb |
| Ni/Clay | Ambient | Ambient | 32 ppb | 4.2 ppb |
| Ni/Clay | 65° C. | 30 psig | 32 ppb | 2.4 ppb |
| Ni/Clay | 100° C. | 50 psig | 32 ppb | 2.3 ppb |

As indicated by this data, it was found that the Ni adsorbent removed about 90% of the mercury while the Cu adsorbent virtually removed all mercury in the feed solutions.

EXAMPLE II

In this example, the adsorbent comprise 33% cupric oxide, 33% zinc oxide, and 64% alumina.

The adsorbents had been reduced in an atmosphere of nitrogen containing 1% hydrogen at 325° F.

The adsorbent was mixed, agglomerated and dried in accordance with the procedures described above prior to being reduced in an atmosphere of nitrogen containing 1% hydrogen at 325° F. under a pressure of 200 psig for 24 hours followed by being subjected to a nitrogen atmosphere comprising 2% hydrogen at 400° F. under a pressure of 200 psig for an additional 24 hours.

A hydrocarbon feed stream, i.e., Algerian naphtha containing 2.2 ppm elemental mercury was then exposed to the adsorbent under conditions suitable for adsorption including a temperature of about 90° C., at a pressure of about 300 psig, and a flow rate of 5 LHSV. The results are tabulated below:

TABLE

| Bed Volume of Feed Passed the Adsorbent Column | Mercury in Product | % Removal |
|---|---|---|
| 360 | <1 ppb | ~100% |
| 480 | 1.0 ppb | 99.95% |
| 600 | 1.2 ppb | 99.95% |
| 868 | 1.5 ppb | 99.93% |
| 988 | 2.2 ppb | 99.90% |
| 1108 | 3.1 ppb | 99.86% |
| 1228 | 80.0 ppb | 96.34% |

As indicated by the tabulated data, substantially all of the elemental mercury contained in the Algerian naphtha was removed in accordance with the present invention.

It will also be appreciated by those of ordinary skill in the art, that, while the present invention has been described herein by reference to particular means, methods, and materials, the scope of the present is not limited thereby, and extends to any and all other means, methods and materials suitable for practice of the present invention. Therefore, although the present has been described with reference to particular means, materials and embodiments, from the foregoing description, one skilled in the art can easily ascertain the essential characteristics of the present invention, and various changes and modifications may be made to various usages and conditions, without departing from the spirit and scope of the invention as described in the claims that follow.

What is claimed is:

1. A method of removing contaminants from a hydrocarbon stream comprising: contacting a hydrocarbon stream containing at least one contaminant comprising a heavy metal with a porous material capable of adsorbing said at least one contaminant under conditions suitable for adsorption of said contaminant by said porous material, wherein said material capable of adsorbing said heavy metal comprises a porous adsorbent comprising (1) a support selected from the group consisting of crystalline aluminosilicates, amphorous aluminosilicates, alumina, silica, clay, zinc oxide, and mixtures of crystalline aluminosilicates, amphorous aluminosilicates, silica, clay, and metal oxides; and (2) active metals dispersed on said absorbent wherein said active metals are selected from the group consisting of Ga, In, and Tl.

2. A method of removing contaminants from a hydrocarbon stream comprising: contacting a hydrocarbon stream, wherein said hydrocarbon stream in the liquid state and is a naptha stream, containing at least one contaminant, wherein said naptha stream contains an amount up to about 2 ppm mercury as said at least one contaminant, with a porous material capable of adsorbing said mercury under conditions suitable for adsorption of mercury by said porous material, wherein said contacting comprises passing said naphtha stream through a column packed with said adsorbent at a temperature ranging from ambient to about 100° C. and at a pressure ranging from ambient to about 300 psig, wherein at least about 90% by total weight of said mercury is removed by said adsorbent so as to result in a product stream containing less than about 1 ppb mercury, wherein said material capable of adsorbing said mercury comprises a porous adsorbent, wherein said adsorbent comprises reduced copper supported on zinc oxide and alumina.

* * * * *